US006350029B1

(12) United States Patent
Szlucha et al.

(10) Patent No.: US 6,350,029 B1
(45) Date of Patent: Feb. 26, 2002

(54) OUTPUT TRAY FOR PRINTING DEVICE

(75) Inventors: Thomas F. Szlucha; Vittal Shenoy; William R. Burger, all of Fairport; Eric A. Merz, Webster, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/337,564

(22) Filed: Jun. 22, 1999

(51) Int. Cl.[7] ..... B41J 2/01
(52) U.S. Cl. ..... 347/104
(58) Field of Search ..... 347/104; 400/584; 271/9.01, 9.09

(56) References Cited

U.S. PATENT DOCUMENTS 5,595,380 A * 1/1997 McCure, Jr. et al. ..... 347/104
6,055,410 A * 4/2000 Marumoto et al. ..... 399/392

OTHER PUBLICATIONS

HP DeskJet 500 Printer Owner's Manual, pp. 1–7, 1–8.

* cited by examiner

*Primary Examiner*—John Barlow
*Assistant Examiner*—An H. Do
(74) *Attorney, Agent, or Firm*—Perman & Green, LLP

(57) ABSTRACT

A printing device having a frame, an input holding area, and an output holding area. The frame supports a printhead and a feed roller system for feeding print medium to the printhead. The input holding area is disposed on the frame. The output holding area is disposed on the frame. The input holding area holds print medium to be fed into the feed roller system. The output holding area has a support section to receive and support print medium output from the feed roller system. The support section of the output holding area has a bypass feed slot formed therein. The bypass feed slot is substantially straight. The bypass feed slot includes a first slot portion and a second slot portion adjoining the first portion. The second slot portion has a slot width different from the first slot portion.

16 Claims, 5 Drawing Sheets

FIG. 1
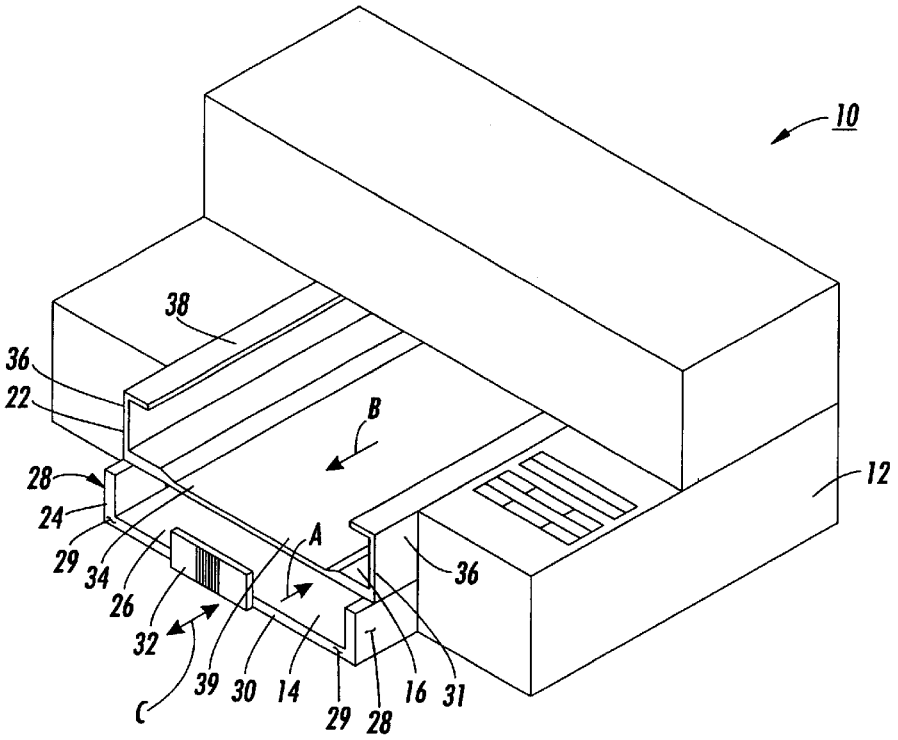
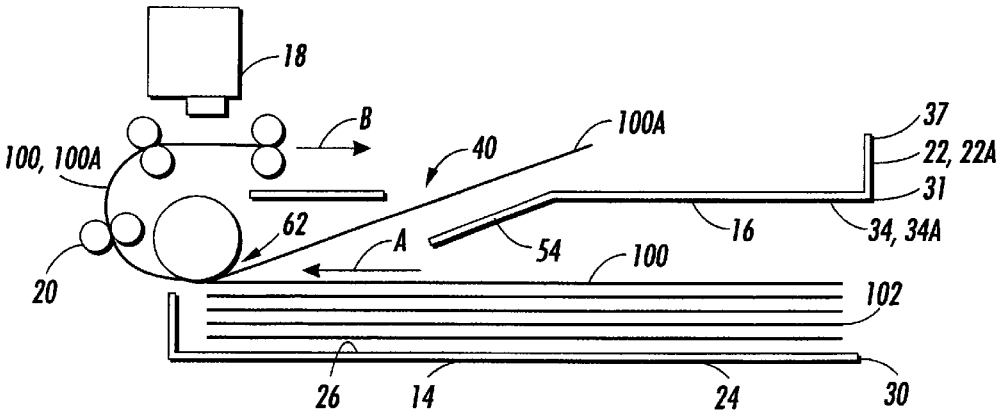
FIG. 2

FIG. 3
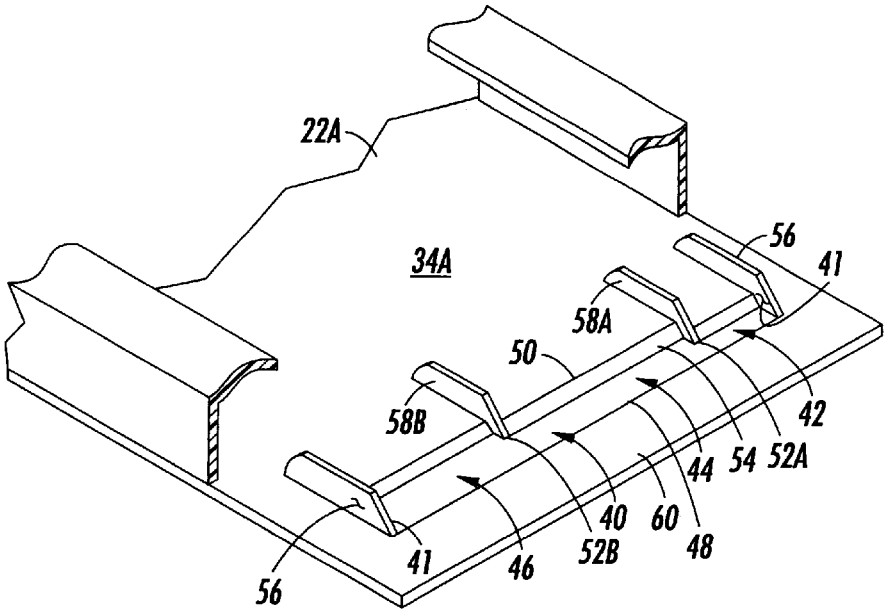
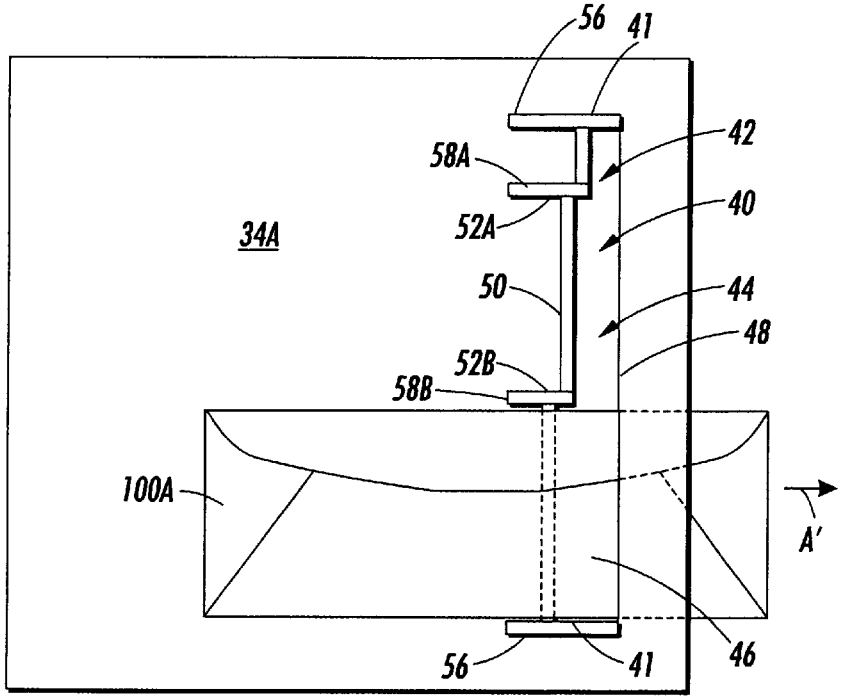
FIG. 4

FIG. 5
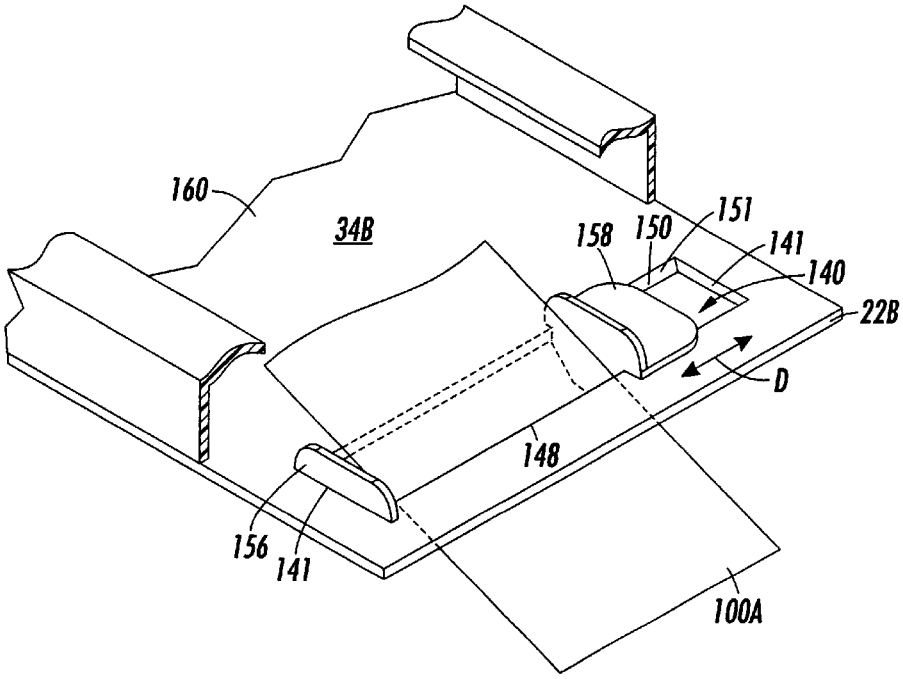
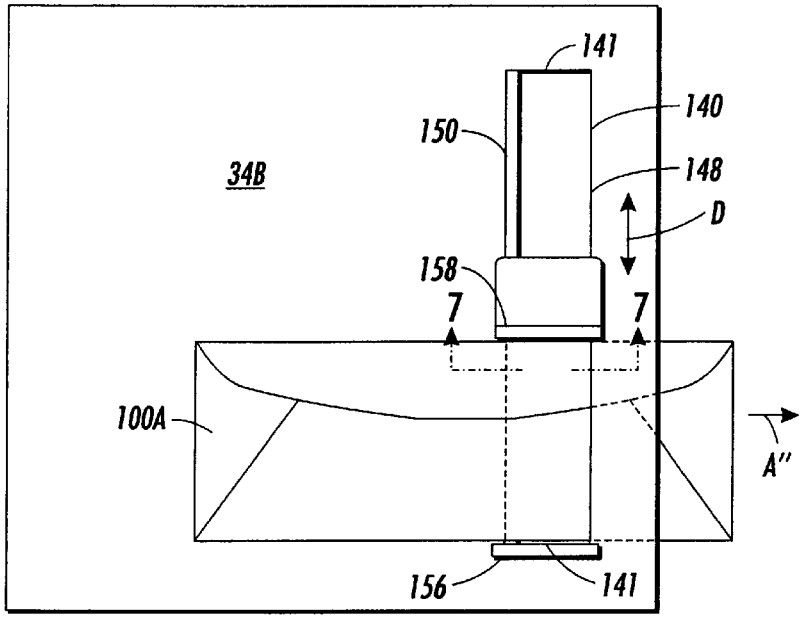
FIG. 6

OUTPUT TRAY FOR PRINTING DEVICE

BACKGROUND OF THE INVENTION

1. Field of the Invention

The present invention relates to an output tray for a printing device and, more particularly, to an output tray having a bypass feed slot.

2. Prior Art

U.S. Pat. No. 5,595,380 discloses a sheet media handling system for use in a printer. The system incorporates an input tray for storing one or more sheet media, and a single sheet medium guide mechanism adjacent to the printer's output support structure.

SUMMARY OF THE INVENTION

In accordance with a first embodiment of the present invention, a printing device is provided. The printing device comprises a frame, an input holding area, and an output holding area. The frame supports a print head and a feed roller system for feeding print medium to the print head. The input holding the area is disposed on the frame. The input holding area holds print medium to be fed into the feed roller system. The output holding area is disposed on the frame. The output holding area has a support section to receive and support print medium which is output from the feed roller system. The support section of the output holding area has a bypass feed slot formed therein. The bypass feed slot is substantially straight and comprises a first slot portion, and a second slot portion. The second slot portion adjoins the first slot portion. The second slot portion has a slot width which is different from the first slot portion.

In accordance with a second embodiment of the present invention, a printing device is provided. The printing device has a frame supporting a print head and a feed roller system. The frame further supports an input tray, and an output tray. The input tray holds print medium which is to be fed into the feed roller system. The output tray holds print medium which is output from the feed roller system. The output tray has a bypass feed slot formed therein. The bypass feed slot has closed lateral ends and an edge which has a general step profile.

In accordance with a third embodiment of the present invention, a printing device is provided. The printing device comprises a frame, holding a print head and a feed roller system, an input tray, and an output tray. The input tray is connected to the frame. The output tray is also connected to the frame. The feed roller system feeds print medium to the print head. The input tray holds print medium to be fed into the feed roller system. The output tray has a support section to receive and support print medium which is output from the feed roller system. The support section of the output tray has a bypass feed slot formed therein. The output tray comprises at least one guide element which is slidably mounted to the output tray so that the guide element can be moved to any position along the feed slot.

BRIEF DESCRIPTION OF THE DRAWINGS

The foregoing aspects and other features of the present invention are explained in the following description, taken in connection with the accompanying drawings, wherein:

FIG. 1 is a perspective view of a printing device incorporating features of the present invention;

FIG. 2 is a schematic cross-sectional view of portions of the printing device shown in FIG. 1;

FIG. 3 is a first partial perspective view of an output tray of the printing device shown in FIG. 1 in a accordance with a first preferred embodiment of the present invention;

FIG. 4 is a top plan view of the support section of the output tray shown in FIG. 3 with an envelope in one of the slots;

FIG. 5 is a partial perspective view of the output tray of the printing device in FIG. 1 in accordance with a second preferred embodiment of the present invention with an envelope in the by-pass slot;

FIG. 6 is a top plan view of the support section of the output tray shown in FIG. 5;

DETAILED DESCRIPTION OF THE PREFERRED EMBODIMENTS

Figure 7:
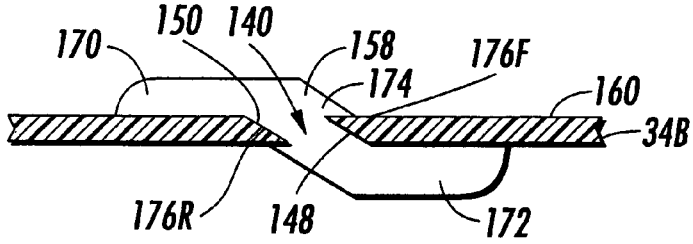
FIG. 7 is a partial cross-sectional view of the support section shown in FIG. 6 taken along line 7—7 but not showing the envelope.

Referring to FIG. 1, there is shown a perspective view of a printing device 10 incorporating features of the present invention. Although the present invention will be described with reference to the embodiments shown in the drawings, it should be understood that the present invention can be embodied in many alternate forms of embodiments. In addition, any suitable size, shape or type of elements or materials could be used.

Referring also to FIG. 2, the printing device 10 generally comprises a frame 12 which supports a printhead 18, a feed roller system 20, an input holding structure or area 14, and an output holding structure or area 16. The input holding area 14 holds a supply of print medium 100 to be input into the feed roller system 20. The output holding area 16 holds print medium output from the feed roller system 20 and print head 18. As seen best in FIG. 2, operation of the printing device 10 generally involves picking up single layers or sheets of print medium 100 from the input holding area 14 and feeding the single sheets of print medium, as indicated by arrow A, with the feed roller system 20 to the printhead 18. The single sheets of the print medium 100 are then expelled by the feed roller system 20, as indicated by arrow B, into the output holding area 16 of the printing device 10. Typically, the single sheets of print medium 100 are picked up one at a time from the top of the supply stack 102 in the input holding area 14. The printing device 10 is generally capable of handling various types and sizes of print medium 100. For example, print medium 100 may include sheets of standard letter size (8½"×11"), legal size (8½"×14"), A4 short edge size, and various other narrow sheet medium such as, envelopes, post cards, and other stationary. The print medium may also include transparencies as well as paper of various quality.

As shown in FIGS. 1 and 2, the printing device 10 has generally only one input holding area 14. This configuration presents a problem in the prior art to a user who wishes to print a single sheet of print medium which is of a different size or quality from the sheets in the supply stack 102 held in the input holding area. To print a single sheet of different size in the prior art, the user has to place the different size piece on top of the supply stack and print as described above. Otherwise, the user has to remove the entire stack from the input area, print the different sized sheet and then restore the stack to the input holding area after the sheet is output into the output holding area. Neither of the two aforementioned cases is entirely satisfactory. In the prior case, the user must carefully align the different size sheet in the holding area to ensure that the sheet is not skewed when entering the feed roller system. However, the difference in size between the stack and the new sheet makes it difficult to properly align the new sheet. In the latter case, the user suffers delays associated with removing and returning the stack to the input holding area. The present invention overcomes these problems, allowing the user to bypass the input holding area and print one or more single print medium without disturbing the supply stack 102 held in the input area 14 as will be explained in greater detail below.

In particular, the printing device 10 in FIG. 1 is depicted as having the configuration of a printer, such as a ink-jet printer, and though the present invention will be described with particular reference to the printer shown, the present invention is equally applicable to other printing devices such as facsimile machines, copiers, and multi-function devices such as a combined computer printer, facsimile, optical scanner and/or copier. Still referring to FIGS. 1 and 2, the input and output holding areas 14, 16 of the printing device 10 are located adjacent to each other; one above the other. Preferably, the output holding area 16 of the printing device 10 comprises a tray 22 which is removably mounted to the frame 12. The input holding area 14 also comprises a tray 24 removably mounted to the printer frame 12. In alternate embodiments, the printing device may have either or both the input holding area and the output holding area integrally formed into the frame. In other alternate embodiments, the input holding area and output holding area may be included in a common removable tray. Both the input and output trays 24, 22 are mounted horizontally to the frame 12, as shown in FIG. 1. In alternate embodiments, the input and output trays may be orientated vertically on the printing device or in any other suitable orientation. Each tray 24, 22 may be installed or removed independently from the printer frame 12 by sliding the tray horizontally into or out of the frame 12 as indicated by arrow C. The output holding tray 22 is located substantially over the input tray 24. The lower input tray 24 holds the stack 102 of print medium sheets 100 which are withdrawn by the feed roller system 20 and fed to the printing head 18 of the printing device 10. The feed roller system 20 expels the print medium 100 into the upper output tray 22 (see FIG. 2).

The input tray 24 generally comprises a lower support surface 26 which extends between two side walls 28 (see FIGS. 1, 2). The side walls 28 extend longitudinally along the lateral edges 29 of the tray 24. At its outer end 30, the input tray 24 has a member 32 (see FIG. 1). The member 32 is used to push print medium 100 towards the feed roller system 20.

As shown in FIG. 1, the output tray 22 generally comprises a lower support surface 34 which extends between two side walls 36. Each of the side walls 36 of the output tray 22 has a lateral flange 38 extending over the lower support surface 34. In alternate embodiments, the side walls of the output tray may be without lateral flanges. The output tray shown in FIG. 1 also has a general depression 39 formed in the lower support surface which may not be present in alternate embodiments. As seen best in FIG. 2, a stop surface 37 may be provided which projects upward from the lower support surface 34 at the outer end 31 of the output tray 22.

Referring now to FIGS. 3 and 4, there is shown respectively a partial perspective view and a top plan view of an output tray 22A, incorporating features in accordance with a first preferred embodiment of the present invention. The lower support surface 34A has a bypass feed slot 40 formed therein. The bypass feed slot 40 has closed lateral ends 41. The bypass feed slot 40 is substantially straight and extends laterally substantially across the width of the support surface 34A of the output tray 22A. The front or inner edge 48 of the bypass slot 40 is substantially straight. The rear or outer edge 50 of the bypass slot 40 has a general stepped profile. As seen best in FIG. 4, the rear edge 50 has two steps 52A, 52B, though in alternate embodiments the number of steps formed in the rear edge may vary. For example, the rear edge may be formed with only one step or three steps. In other alternate embodiments, the rear edge may be substantially straight and the front edge may have a stepped profile. In still other alternate embodiments, both front and rear edges of the bypass slot may have stepped profiles. The two steps 52A, 52B in the rear edge 50 define a first portion 42, a second portion 44, and a third portion 46 of the bypass slot 40. The depth of the bypass slot 40 from front edge 48 to rear edge 50 varies along the width of the slot arising from the stepped profile of the rear edge 50. Accordingly, the slot in the second portion 44 of the bypass slot 40 is narrower than the slot in the third portion 46, and the slot in the first portion 42 is narrower still in comparison to the slot in the second portion 44. However, in alternate embodiments, the depth corresponding to the first, second and third portions of the bypass slot may be distributed such that the third or the second portions have the narrowest slot depth. The overall width of the bypass feed slot 40, between the closed lateral ends 41, is sufficient such that sheets of print medium having a standard 8½" width (not shown) can be admitted through the slot 40. The combined width of the second and third potions 44, 46 of the bypass slot 40 is sufficient such that sheets of print medium with a width corresponding to standard A4 format (not shown) can be admitted between step 52A and the opposing closed lateral end 41 of the slot 40. The width of the third portion 46 is sufficient such that sheets of print medium 100A having a standard envelope width can be admitted between step 52B and the opposing closed lateral end 41 of the slot 40. As shown in FIGS. 2 and 3, the rear edge 50 of the bypass feed slot 40 has a sloped surface 54 suited to guide the single sheets of print medium 100A fed through the bypass slot 40 to the intake of the feed roller system 20. In alternate embodiments, the front edge of the slot may have a surface sloped to complement the sloped surface 54 on the rear edge of the slot. Print media guide members 56, 58A, 58B project from the top 60 of the support surface 34A. The outer guide members 56 are located at the lateral ends 41 of the bypass feed slot 40 sufficiently apart to guide substantially without skew standard 8½" wide print medium sheets (not shown) fed through the slot 40. Intermediate guide members 58A, 58B are located at the corresponding steps 52A, 52B in the rear edge 50 of the slot. Guide member 58A is located to closely guide in cooperation with opposing guide member 56 standard A4 size print medium sheets (not shown) fed through the second and third portions 44, 46 of the slot 40. Intermediate guide member 58B is located to closely guide in cooperation with opposing guide member 56 standard envelope size sheets of print medium 100A fed through the third portion 46 of the bypass slot 40 as shown in FIG. 4. In alternate embodiments, guide members may also project from the bottom of the support surface of the output tray. The guide members which project from the bottom of the support surface of the output tray may be located in front of the bypass slot.

Generally, to commence printing operations, the user loads print medium 100 into the input tray 24 of the printing device 10. To load the print medium 100, the user removes the input tray 24 from the frame 12, places a stack 102 of sheets of print medium 100 into the input tray and returns the tray into the frame. The user may then queue the printing device 10 and commence printing operations. In accordance with the first preferred embodiment of the present invention, when the user desires to print a sheet of print medium 100A which is of a different type or size than the print medium sheets 100 loaded in the input tray 24, the user inserts the print medium sheet 100A into the bypass feed slot 40 in the output tray 22. Specifically, the user inserts the print medium sheet 100A into the appropriate sections 42, 44, 46 of the slot 40. For example, as shown in FIG. 4, in the case when the print medium sheet 100A is an envelope, the user inserts the envelope into the third portion 46 of the bypass slot 40. Alternatively, when the print medium has a width which corresponds to standard A4 size sheets (not shown), the print medium is inserted into the section of the slot 40 made up of the second and third portions 44, 46. Print medium which has a standard width of 8½" (not shown) is inserted into the entire slot 40. As the user inserts the print medium 100A into the slot 40, the appropriate guides 56, 58A, 58B guide the print medium to prevent skew of the medium 100A relative to the feed roller system 20. As depicted in FIG. 4, in the case where the print medium 100A is an envelope, guides 58B and 56 closely guide the envelope as it is inserted forward, in the direction of indicated by arrow A', to the feed roller system 20. As seen in FIG. 2, the sloped surface 54 of the slot 40 generally maintains the print medium 100A aligned with the intake 62 of the feed roller system 20. The user stops inserting the print medium 100A into the bypass slot 40 when the user senses that the print medium sheet 100A contacts the feed roller system 20. In this position, the print medium 100A inserted through the bypass feed slot 40 will be drawn into the feed roller system 20 before sheets of print medium 100 held in the input tray 24. Thus, sheets of print medium 100A fed through the bypass slot 40 in the output tray 22A bypass the stack 102 of print medium 100 held in the input tray 24, and the user may print one or more single sheets of print medium 101A without having to disturb the print medium 100 held in the input tray 24. Additionally, when the input tray 24 is otherwise empty, the user may still print one or more single sheets of print medium 100A following substantially the procedure described above. In this manner, the user may rapidly print a desired number of single sheets without having to remove and load print medium 100 into the input tray.

FIGS. 5 and 6 show a second preferred embodiment of an output tray 22B of the printing device 10 in accordance with a second preferred embodiment of the present invention. The output tray 22B is substantially similar to the output tray 22A described previously with respect to the first preferred embodiment of the present invention. The output tray 22B, in the second preferred embodiment, has a lower support surface 34B to receive and support print medium output from the feed roller system 20 of the printing device 10 (see FIG. 2). The lower support surface has a bypass feed slot 140 formed therein. The bypass feed slot 140 has closed lateral ends 141 and front and rear edges 148, 150 which are substantially straight. The bypass feed slot 140 extends across the width of the support surface 34B and has a slot length sufficient to admit therein print medium sheets raging in width up to and including standard 8½" sheets. Alternatively, in output trays having a larger width and adapted to support print medium sheets which are wider than a standard 8½", the length of the bypass slot may correspondingly be increased up to the maximum width of the output tray so that wider print medium sheets may be inserted through the slot.

Referring now also to FIG. 7, in the second preferred embodiment of the present invention, the output tray includes a fixed guide member 156 and a sliding guide element 158 for guiding print medium 100A inserted into the bypass feed slot 140. The fixed guide member 156 projects from the top 160 of the support surface 34B at one end 141 of the slot 140. The sliding guide element 158 is mounted to the support surface 34B of the output tray 22B within the bypass slot 140. As seen best in FIG. 7, the sliding guide element 158 has preferably a general Z shaped configuration. The guide element 158 includes an upper guide arm 170 connected to a lower guide arm 172 by a central member 174. The central member 174 has a front groove 176F and a rear groove 176R formed therein. The front and rear grooves 176F, 176R of the guide element 158 are adapted to receive respectively the front edge 148 and rear edge 150 of the bypass slot 140 in the output tray 22B. The front groove 176F complements the profile of the front edge 148 of the slot 140, and the rear groove 176R complements the profile of the rear edge 150 of the slot.

When the sliding guide element 158 is mounted to the output tray 22B, the front edge 148 of the slot is located in the front groove 176F of the guide element 158, and the rear edge 150 of the slot is located in the rear groove 176R of the guide element. Accordingly, the guide element 158 is captured in support surface 34B of the output tray 22B, but is otherwise free to slide to any location along the length of the bypass feed slot 140. The upper guide arm 170 of the guide element 158 is located above the support surface 34B and the lower guide arm 172 is located below the support surface 34B. In alternate embodiments, the sliding guide member may have any other suitable shape which provides generally vertical guide surfaces to print medium inserted into the bypass feed slot. Also, the sliding guide element may be mounted to the output tray using any other suitable means which allow the guide element to slide to any location along the length of the bypass slot. For example, the sliding guide element may be mounted on a dedicated rail or track in the support surface, which track is substantially parallel to the bypass feed slot. The user may move the guide element to any location along the length of the bypass slot by sliding the element along this dedicated track.

As shown in FIG. 7, the rear edge 150 of the bypass slot 140 has a sloped surface 151. The front edge 148 of the slot 140 has a sloped surface 149 complementing the sloped surface 151 on the rear edge 150 of the slot. The front and rear sloped surfaces 149, 151 of the bypass slot 140 are angled to guide a sheet of print medium 100A inserted through the slot 140 to the intake 62 of the feed roller system 20 (see FIG. 2).

In accordance with the second preferred embodiment of the present invention, when the user desires to print one or more single print medium 100A but bypass the input tray 24 of the printing device 10, the user inserts the print medium 100A through the bypass feed slot 140 of the output tray 22B (see FIGS. 5–6). The user slides the sliding guide element 158 to a position within the bypass slot 140 such that the print medium 100A inserted in the bypass slot is nested without substantial skew between the slide element 158 and the fixed guide member 156. The slide element 158 and fixed guide 156 thus prevent the print medium 100A inserted through the bypass slot 140 from being skewed with respect to the feed roller system of the printing device. The slot length between the sliding guide element 158 and the fixed guide 156 can be linearly adjusted as desired to accommodate print medium 100A of various widths ranging up to the entire length of the bypass slot. As described previously with respect to the first preferred embodiment of the present invention, the user stops inserting the print medium 100A into the bypass slot 140 upon sensing that the print medium contacts the intake 62 of the feed roller system 20 of the printing device 10 (see FIG. 2). Activation of the feed roller system 20, when the print medium 100A in the bypass slot 140 is in this position, will feed the print medium 100A to the printhead 18 bypassing any print medium 100 held in the input tray 24 of the printing device 10.

Figure 8:
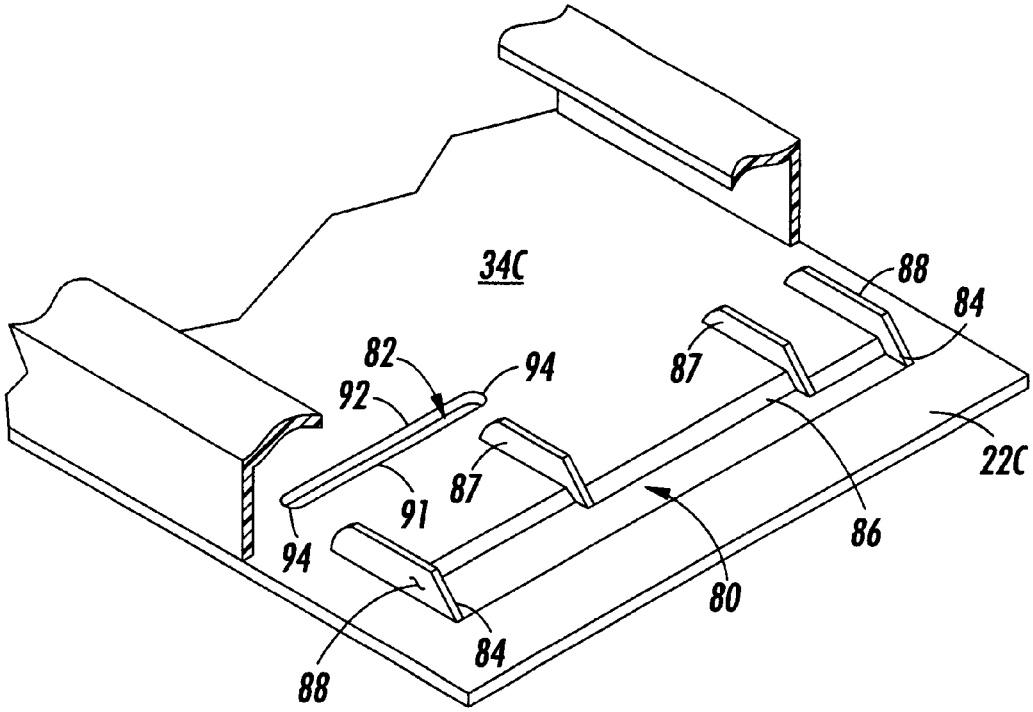
FIG. 8 is a partial perspective view of the output tray of the printing device in FIG. 1 in accordance with a third preferred embodiment of the present invention.

A third embodiment of the output tray 22C of the printing device 10 is shown in FIG. 8. In this embodiment, the support section 34C of the output tray 22C has two bypass feed slots 80, 82 formed therein. The two bypass feed slots 80, 82 are longitudinally displaced from each other with one slot 80 being located in front of the other 82. The front slot 80 is substantially similar to the bypass slot 40 (see also FIG. 3) described previously with respect to the first preferred embodiment of the present invention. The front slot 80 is substantially straight with closed lateral ends 84. The front slot has a rear edge 86 which has a generally stepped profile. Guide members 87, 88 project from the support section 34C adjacent to the front slot 80. In alternate embodiments, the front slot may have substantially straight both front and rear edges. The rear slot 82 has substantially straight front and rear edges 91, 92 closed by lateral ends 94. The front and rear slots 80, 82 have different widths and depths. In the third preferred embodiment, the front slot 80 is wider than the rear slot 82. The width of the front slot between ends 84 is adapted to admit sheets of print medium such as standard 8½" or wider if possible within the width constraints of the support section of the output tray. The rear slot 82 has a length suitable to admit envelopes. In alternate embodiments, the shorter bypass slot may be located in front of the longer slot. In other alternate embodiments, the support section of the output tray may have additional (e.g. three or more) separate and spaced bypass feed slots, each having a different width to admit print medium of different widths.

In accordance with the third preferred embodiment of the present invention, when the user wants to print one or more single sheets of print medium but not use the input tray of the printing device, the user inserts the print medium through the appropriate bypass feed slot 80, 82 of the output tray 22C. For example, envelopes may be inserted through the rear slot 82, and wider print medium through the front slot 80. As described previously, the user inserts the print medium into the bypass slot 80, 82 until sensing contact with the intake of the feed roller system. At this point the user is ready to print the print medium inserted in the bypass slot.

Figure 9:
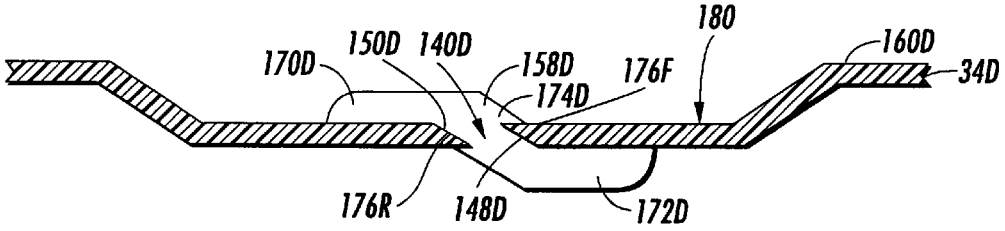
FIG. 9 is a partial cross-sectional view of the support section of the output tray of the printing device shown in FIG. 1 in accordance with a fourth embodiment of the present invention.

FIG. 9 shows a partial cross-sectional view of the support section 34D of the output tray 22D according to a fourth embodiment of the present invention. In this embodiment, the support section 34D of the output tray 22D includes a recessed region 180. The bypass slot 140D and associated guide element 158D of the output tray 22D are located in the recessed region 180. The bypass slot and associated guide element in this embodiment may be substantially similar to bypass slot 40 (see FIGS. 3 and 4) or to bypass slot 140 (see FIGS. 5–7) described previously. For example purposes, however, in FIG. 9 the bypass slot 140D of the fourth embodiment is shown as having substantially the same configuration as bypass slot 140 with guide element 158 seen best in FIGS. 5–7. Similar reference numerals are used in FIG. 9 to designate features similar to those shown in FIGS. 5–7. In alternate embodiments, the bypass slot and guide elements located in the recess of the bypass tray may have any other suitable configuration. The recess 180 in the output tray 22D has sufficient depth such that the guide element 158D is located below the upper surface 160D of the support section 34D of the tray. Accordingly, sheet medium 100 (see FIG. 2) output into the output tray 22D may pass directly over the bypass slot 140D and guide element 158D without being snagged on the slot or guide element.

The present invention allows a user to print one or more single print medium without having to use the input tray 24 of the printing device 10. Instead, the user may insert single items of print medium into the bypass feed slot 40, 140, 80, 82 of the output tray 22A, 22B, 22C. In addition, the bypass feed slots 40, 140, 80, 82 in the output tray 22A, 22B, 22C of the printing device of the present invention provide for accurately guiding print medium of different sizes into the feed roller system of the printing device. Thus, the user may print without substantial delay consecutive items of print medium of different size. For example, if the user has standard 8½×11" sheets of paper loaded in the input tray of the printing device, the present invention allows the user to print an envelope and substantially immediately thereafter to print a sheet of A4 paper and immediately after that to print a standard 8½×11" size transparency. The user may consecutively print the different size sheets by inserting them sequentially through the bypass feed slot in the output tray of the printing device of the present invention and not once does the user have to spend time unloading and reloading the input tray. The bypass feed slots in printing devices of the prior art are adapted to guide accurately only print medium sheets having one designated size. Printing sheets having a size which is different than the designated size requires that the user in the prior art load such sheets in the input tray. The present invention, however, provides the user with the ability to print not just one but rather a wide range of sizes of print medium sheets without having to remove, unload and reload print medium into the input tray of the printing device.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A printing device comprising:

a frame supporting a printhead and a feed roller system for feeding print medium to the printhead;

an input holding area disposed on the frame for holding print medium to be fed into the feed roller system; and an output holding area disposed on the frame, the output holding area having a support section to receive and support print medium output from the feed roller system;

wherein, the support section of the output holding area has a bypass feed slot formed therein, the bypass feed slot being substantially straight and comprising a first slot portion and a second slot portion adjoining the first portion, the second slot portion having a slot width different from the first slot portion.

2. A printing device as set forth in claim 1, wherein the support section of the output holding area has a support surface for supporting print medium output from the feed roller system, and wherein the bypass feed slot is formed in the support surface of the support section.

3. A printing device as set forth in claim 1, wherein the output holding area comprises a tray removably connected to the frame, the removable tray being connected to the frame at a location substantially over the input holding area.

4. A printing device as set forth in claim 1, wherein the support section of the output holding area comprises at least one additional bypass feed slot.

5. A printing device as set forth in claim 4, wherein each one of the bypass feed slots in the output tray is adapted to guide corresponding print medium fed through each slot into the feed roller system bypassing the input tray.

6. A printing device as set forth in claim 1, wherein the bypass feed slot comprises a third slot portion adjoining the second slot portion, the third slot portion having a corresponding slot width different than the first and second portions of the bypass feed slot.

7. A printing device as set forth in claim 1, wherein the bypass feed slot extends substantially across a width of the support section of the output holding area.

8. A printing device as set forth in claim 1, wherein the bypass feed slot is bounded at opposite ends by guide members projecting from the support section of the output area, and wherein an intermediate guide member projects from the support section at a transition between the first portion and the second portion of the bypass feed slot.

9. A printing device as set forth in claim 1, wherein the first portion and the second portion of the bypass feed slot have a combined length sufficient to accommodate a first print medium having a first predetermined dimension, and the second portion has an individual length sufficient to accommodate a second print medium having a second predetermined dimension.

10. A printing device as set forth in claim 1, wherein the support section of the output holding area has a recess formed therein, and wherein the bypass slot is located in the recess.

11. In a printing device having a frame supporting a printhead and a feed roller system, an input tray to hold print medium to be fed into the feed roller system, and an output tray to hold print medium output from the feed roller system, wherein the improvement comprises:

the output tray having a bypass feed slot formed therein, the bypass feed slot having closed lateral ends and an edge which has a general stepped profile.

12. A printing device as set forth in claim 11, wherein the bypass feed slot is substantially straight and comprises a first slot portion and a second slot portion, the first portion and second portion of the bypass feed slot being defined by the general stepped profile of the slot edge wherein the second portion has a width different than the first portion of the slot.

13. A printing device as set forth in claim 11, wherein the bypass feed slot is formed in a lower support section of the output tray, the feed slot being located between guide members projecting from a surface of the lower support section at opposite ends of the feed slot, and wherein additional guide members project from the surface of the lower support section adjoining each step in the edge of the slot having the general stepped profile.

14. A printing device comprising:

a frame holding a printhead and a feed roller system for feeding print medium to the printhead;

an input tray connected to the frame to hold print medium to be fed into the feed roller system; and an output tray connected to the frame, the output tray having a support section to receive and support print medium output from the feed roller system;

wherein, the support section of the output tray has a bypass feed slot formed therein, and wherein the output tray comprises at least one guide element slidably mounted to the output tray so that the guide element can be moved to any position along the feed slot.

15. A printing device as set forth in claim 14, wherein the bypass feed slot is substantially straight and extends substantially across a width of the output tray.

16. A printing device as set forth in claim 14, wherein the guide element is held within the bypass feed slot.

* * * * *